US009447789B2

(12) United States Patent
Chang et al.

(10) Patent No.: US 9,447,789 B2
(45) Date of Patent: Sep. 20, 2016

(54) FAN ASSEMBLY

(75) Inventors: Shun-Chen Chang, Taoyuan Hsien (TW); Bo-Chun Chen, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 781 days.

(21) Appl. No.: 13/480,856

(22) Filed: May 25, 2012

(65) Prior Publication Data

US 2012/0301274 A1 Nov. 29, 2012

(30) Foreign Application Priority Data

May 26, 2011 (TW) ..... 100118387 A

(51) Int. Cl.
*F04D 25/08* (2006.01)
*F04D 29/54* (2006.01)

(52) U.S. Cl.
CPC ..... *F04D 25/08* (2013.01); *F04D 29/541* (2013.01)

(58) Field of Classification Search
CPC ..... F24F 7/00; F01D 9/00; F01D 13/00; F04D 3/00; F04D 19/007
See application file for complete search history.

(56) References Cited

U.S. PATENT DOCUMENTS 4,610,601 A * 9/1986 Gerfast ..... 416/234
6,457,955 B1 * 10/2002 Cheng ..... 417/423.8
7,134,839 B2 * 11/2006 Horng et al. ..... 415/199.4
7,828,510 B2 * 11/2010 Chang et al. ..... 415/61
2002/0090308 A1 * 7/2002 Cheng ..... 417/423.1
2007/0031248 A1 * 2/2007 Hsu et al. ..... 415/191
2008/0038114 A1 * 2/2008 Abdelwahab et al. .... 415/211.1
2011/0223042 A1 * 9/2011 Chang et al. ..... 417/313

FOREIGN PATENT DOCUMENTS

DE 706213 5/1941

OTHER PUBLICATIONS

An Office Action from the corresponding Taiwanese Application No. 100118387, mailed Sep. 26, 2013, 6 pages.

* cited by examiner

*Primary Examiner* — Craig Kim
*Assistant Examiner* — Brian O Peters
(74) *Attorney, Agent, or Firm* — Muncy, Geissler, Olds & Lowe P.C.

(57) ABSTRACT

A fan assembly including a housing, a supporting member, a driving device and a passive impeller. The supporting member is disposed in the housing, and the driving device is disposed on the supporting member. The passive impeller includes a first hub and a plurality of first passive blades encircling the first hub. The active impeller includes a second hub and a plurality of active blades encircling the second hub and actuated to rotate by the driving device. In an axial direction, the first hub is disposed between the driving device and the second hub, and through rotation of the active impeller, airflow is produced which actuates the passive impeller to rotate.

21 Claims, 10 Drawing Sheets

FAN ASSEMBLY

CROSS REFERENCE TO RELATED APPLICATIONS

This application claims priority of Taiwan Patent Application No. 100118387, filed on May 26, 2011, the entirety of which is incorporated by reference herein.

BACKGROUND OF THE INVENTION

1. Field of the Invention

The present invention relates to a fan assembly, and in particular relates to a fan assembly which effectively enhances wind energy utilization efficiency.

2. Description of the Related Art

Referring to FIG. 1, a conventional fan includes a rotor 11, a stator 12, and an impeller 14. The rotor 11 is pivoted on a base 13. While the fan operates, due to interacting magnetic fields, the rotor 11 is actuated by the stator 12 to rotate the impeller 14, and airflow is generated through rotation of the blades of the impeller 14.

For the above-described conventional fan, in order to create more airflow, a larger sized impeller is typically used; however, at least two problems are produced.

First, in order to actuate the larger sized impeller, a heavier rotor and a larger actuating system is needed, which produces more torque for the larger sized impeller. However, the fan becomes heavy and costs rise. Second, resulting from the increased size of the fan, the rotating speed of the fan is restricted causing the actuating system to work less efficient and consume more energy.

BRIEF SUMMARY OF THE INVENTION

The invention provides a fan assembly which successfully increases utilization of energy efficiency. Additionally, the durability, functionality, and maintenance of the fan assembly of the invention are taken into account while design.

One of the objectives of the invention is to provide a fan assembly including a housing, a supporting member, a driving device and a passive impeller. The supporting member is disposed in the housing, and the driving device is disposed on the supporting member. The passive impeller includes a first hub and a plurality of first passive blades encircling the first hub. The active impeller includes a second hub and a plurality of active blades encircling the second hub and is driven to rotate by the driving device. The first hub is disposed between the driving device and the second hub along an axial direction, and through rotation of the active impeller, airflow produced thereby actuates the passive impeller to rotate.

The fan assembly further includes a shaft and a bushing, wherein the active impeller is connected to the shaft, and the active impeller is driven by the driving device via the shaft. The first hub of the passive impeller includes a protrusion, and the shaft is telescoped within the protrusion. At least a first bearing is disposed between the shaft and the bushing, and at least a second bearing is disposed between the shaft and the protrusion, wherein the shaft passes through the first bearing and the second bearing. The protrusion extends along a direction toward the driving device or a direction away from the driving device. One end of the shaft is connected to the second hub, and another end of the shaft passes through the first hub and is telescoped within the bushing.

The fan assembly further includes a base which is connected to the bushing with the support member. Preferably, the base and the bushing are formed integrally. The base is a hollowed shell or a plate disposed at an opposite side of the driving device which faces the active impeller.

The driving device further includes a rotor which is connected to the shaft to drive the shaft to rotate, wherein the rotor is connected to an end of the shaft or the rotor is connected to a portion of the shaft which is located between the first bearing and the second bearing. The rotor further includes a connecting portion and a mounting portion, and the connecting portion and plastic injection molded articles is connected to the shaft, and the mounting portion and an iron shell surrounds the bushing The driving device further includes a stator, a magnetic component and a circuit board, and the stator includes a silicon steel strip and coil surrounding the silicon steel strip, wherein the circuit board and the stator are telescoped at the outside of the bushing, and the magnetic component is disposed on an inner wall of the rotor.

At least a part of the driving member is covered by the first hub, and the first passive blades radially encircle the driving member.

The first hub, the second hub and the rotor are calathiform with an opening, respectively, and the openings of the first hub and the second hub face the same direction. The rotor and the first hub are disposed correspondingly wherein the openings of the rotor and the first hub face the same direction. Alternatively, the rotor and the first hub can be disposed reversely wherein the openings of the rotor and the first hub face different directions. The circular board is disposed between the rotor and the first hub.

The active blades and the first passive blades are disposed correspondingly in the axial direction. Each of the active blades and each of the first passive blades respectively has a concave surface and a convex surface on two opposite sides, and the concave surfaces of the active blades face the concave surfaces of the first passive blades. Each of the first passive blades is overlapped by a neighboring first passive blade in the axial direction.

The housing further includes a chamber configured to receive at least one electronic element. The supporting member is fixed to the housing by screw arrangement, or the supporting member and the housing are formed integrally. The support member is a rib or a static blade, and the support member and the base are formed integrally. Alternatively, the supporting member includes a rib or a static blade which is formed integrally with the base through injection molding.

A gap is constituted between the active impeller and the passive impeller, such that there is no connection between the active impeller and the passive impeller. A rotating direction of the active blades is the same as a rotating direction of the first passive blades The passive impeller further includes a plurality of second passive blades encircling the first passive blades. The passive impeller further includes an airflow guiding ring which is disposed between the first passive blades and the second passive blades to connect the first passive blades to the second passive blades, wherein the first passive blades are connected to an inner wall of the airflow guiding ring and the second passive blades are connected to an outer wall of the airflow guiding ring. An accommodating space is formed by the inner wall of the airflow guiding ring, and at least a portion of the active blades are disposed in the accommodating space. The inner wall of the airflow guiding ring is parallel to or inclined with respect to an axis. The first hub, the first passive blades, the second passive blades, and the airflow guiding ring are integrally formed as a single piece.

The second passive blades radially encircle the first passive blades. The passive impeller further includes an enforcing ring encircling the outer edges of the second passive blades. Lengths of the second passive blades are larger than lengths of the first passive blades. A direction of the airflow generated by the second passive blades is different from or the same as a direction of the airflow generated by the active blades.

By the arrangement of the fan assembly of the invention in which the passive impeller is connected to the shaft via the bearing, the passive impeller is not driven by the shaft directly. In fact, the passive impeller is actuated by airflow produced by the active impeller, wherein the active impeller is driven by the shaft which is operated by the driving device.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

To solve the problems of conventional fans in which a fan with a large size is heavy and tends to by less efficient, a fan assembly is provided in the invention. The fan assembly is light weight, so that a rotation speed of the fan assembly can be substantially increased, and an operation efficiency of the fan assembly can be enhanced. A detailed description is given in the following embodiments with reference to the accompanying drawings.

Figure 1:
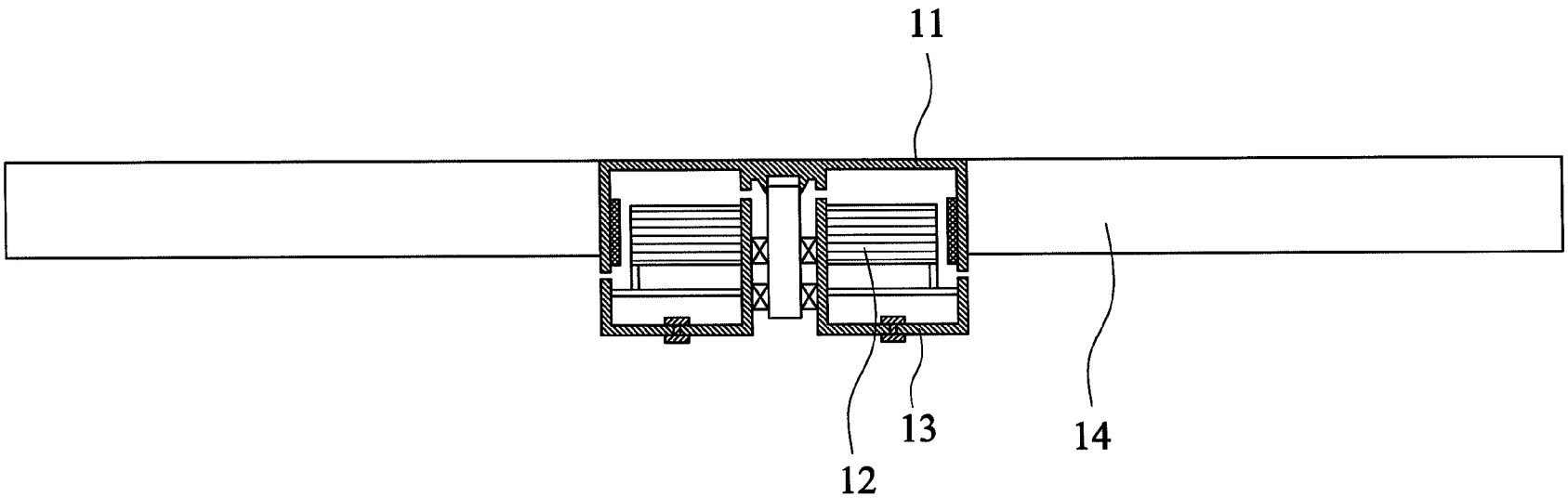
FIG. 1 (PRIOR ART)
FIG. 1 is a schematic view of a conventional fan.
Figure 2:
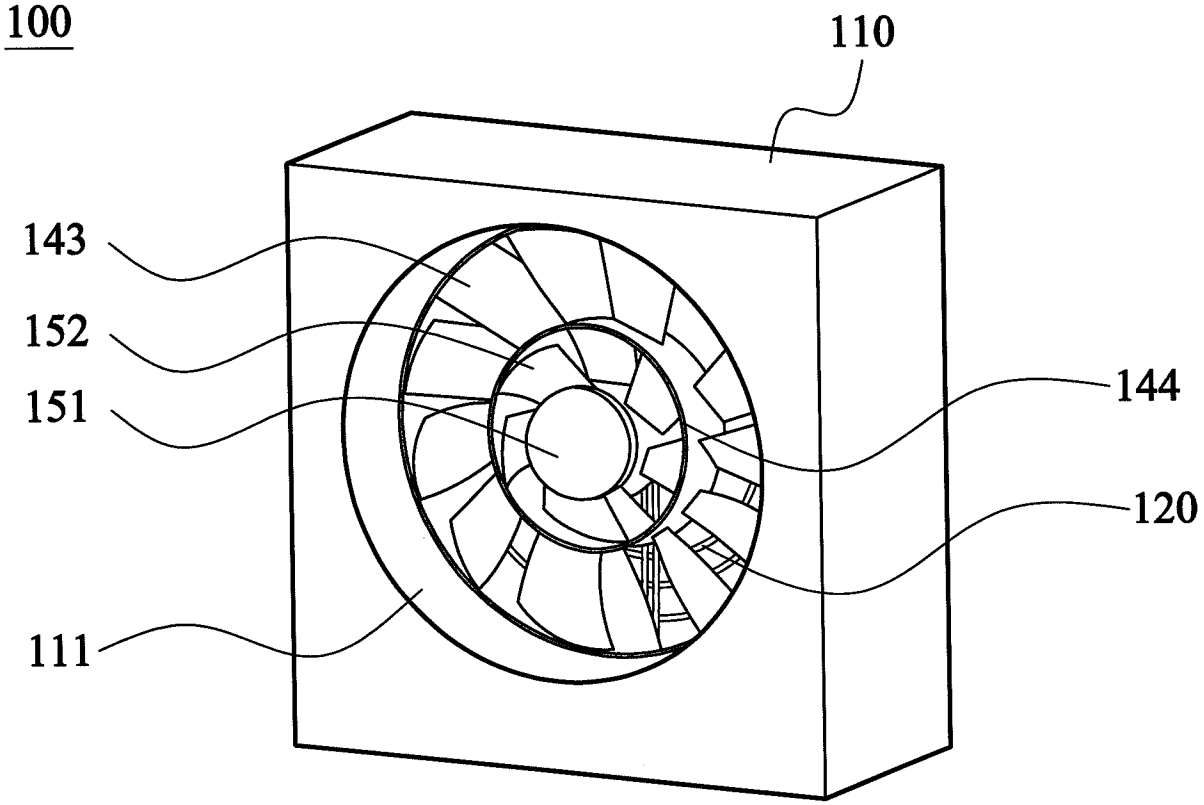
FIG. 2 is a schematic view of a fan assembly of a first embodiment of the invention.
Figure 3A:
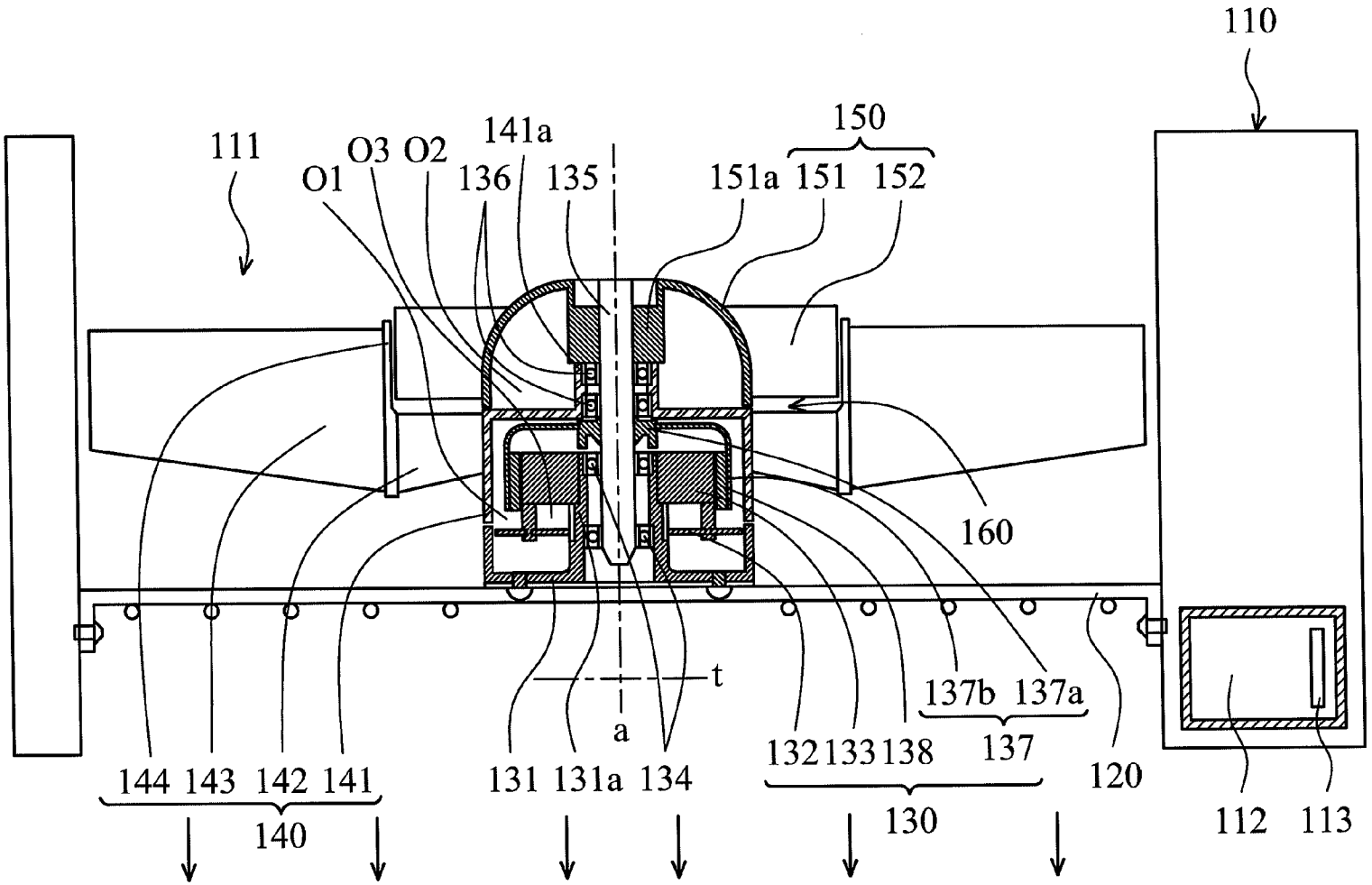
FIG. 3A is sectional schematic views of the fan assembly of the first embodiment of the invention.
Figure 3B:
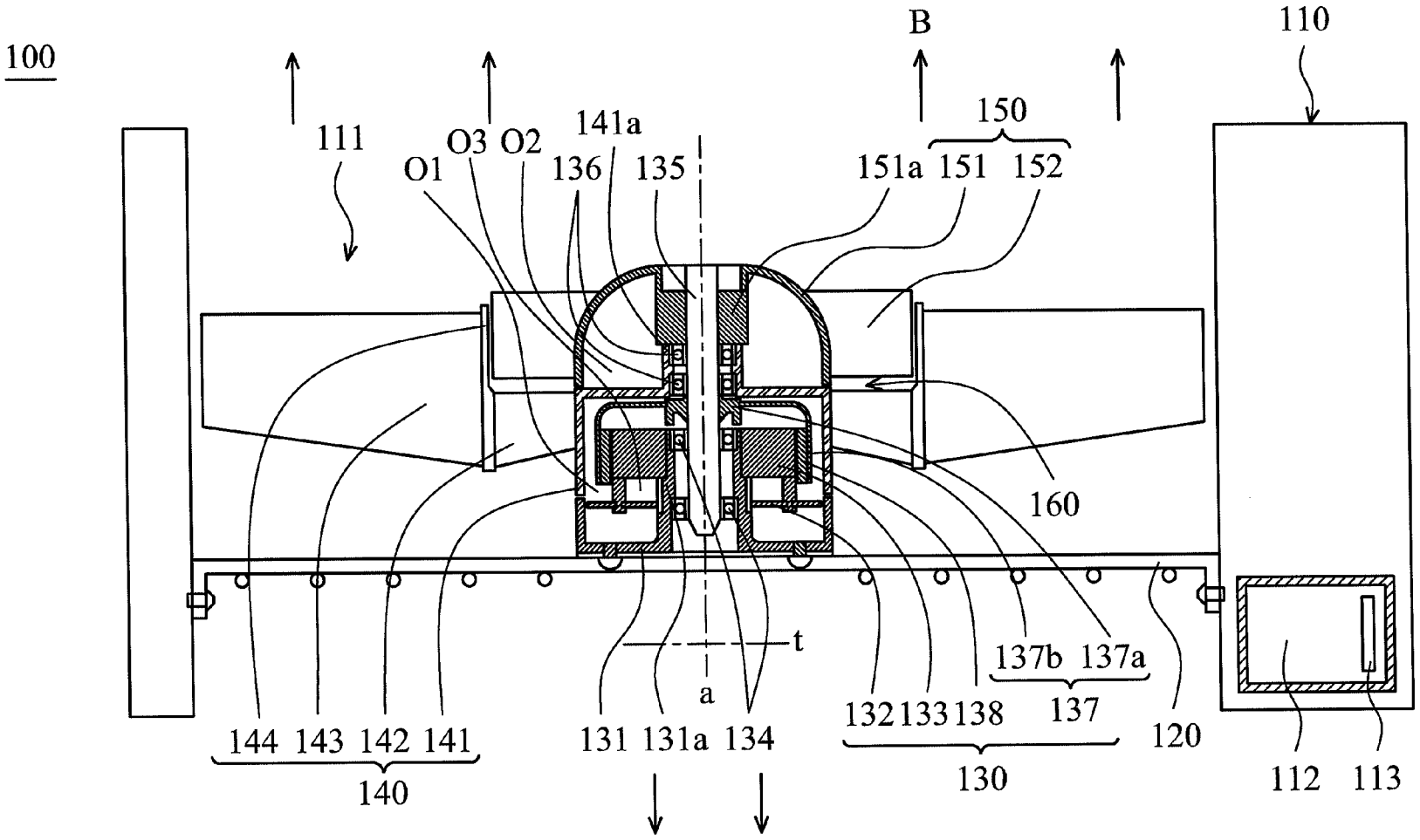
FIG. 3B is sectional schematic views of the fan assembly of the first embodiment of the invention.

Please refer to FIGS. 2, 3A and 3B. In this embodiment, the fan assembly 100 includes a housing 110, a supporting member 120, a base 131, a driving device 130, a passive impeller 140, an active impeller 150, a shaft 135, a bushing 131*a* and at least a first bearing 134 and at least a second bearing 136.

The housing 110 has an air-flowing channel 111 penetrating therethrough, and a chamber 112 is disposed therein for receiving at least one electronic element 113. The supporting member 120 is disposed in the housing 110, and the driving device 130 is disposed on the supporting member 120 and is connected to the supporting member 120. In the embodiment, the support member 120 is a protective cover, and the base 131 is fixed to the protective cover by screw arrangement, but it is not limited thereto. The support member 120 can include ribs or static blades, which can be formed integrally with the base 131 and the housing 110 through injection molding, wherein the support member 120 is connected to the base 131 with the housing 110. The supporting member 129 is disposed in the air-flowing channel 111 and fixed to the housing 110 by screw arrangement.

The passive impeller 140 includes a first hub 141 and a plurality of first passive blades 142 encircling the first hub 141. The active impeller 150 includes a second hub 151 and a plurality of active blades 152 encircling the second hub 151. The second hub 151 has an engagement portion 151*a* for connecting to the shaft 135 so as to allow the driving device 120 to drive the active impeller 152 to rotate. In an axial direction, the first hub 141 of the passive impeller 140 is disposed between the driving device 130 and the second hub 151. Airflow is produced by the active impeller 150, and the passive impeller 140 is actuated by the airflow.

The active impeller 150 is connected to the shaft 135 and driven by the driving device 130 via the shaft 135. The shaft 135 and the bushing 131*a* is extended along a direction parallel to the axis a, and the driving device 130 surrounds the bushing 131*a*, wherein the shaft 135 is telescoped within the bushing 131*a*. The first hub 141 of the passive impeller 140 is a calathiform, and a protrusion 141*a* is extended from the first hub 141, wherein the shaft 135 is telescoped within the protrusion 141*a*. At least a first bearing 134 is disposed between the shaft 135 and the bushing 131*a*, and at least a second bearing 136 is disposed between the shaft 135 and the protrusion 141*a*. In this embodiment, two first bearings 134 and one second bearing 136 are utilized. The shaft 135 passes through the first bearings 134 and the second bearing 136. The protrusion 141*a* extends along a direction away from the driving device 130. A gap is constituted between the active impeller 150 and the passive impeller 140, such that there is no connection between the active impeller 150 and the passive impeller 140. One end of the shaft 135 is connected to the second hub 151, and another end of the shaft 135 passes through the first hub 141 and is telescoped within the bushing 131*a*.

The base 131 is connected to the bushing 131*a* with the support member 120, wherein the base 131 and the bushing 131*a* are preferably formed integrally. The base 131 is a plate which is disposed at an opposite side of the driving device 130 which faces the active impeller 150.

The driving device 130 further includes a rotor 137 which is connected to the shaft 135 to drive the shaft 135 to rotate. The rotor 137 is connected to a portion of the shaft 135 which is located between the first bearing 134 and the second bearing 136. The rotor 137 further includes a connecting portion 137*a* and a mounting portion 137*b*, wherein the connecting portion 137*a* can be plastic injection molded articles connected to the shaft 135, and the mounting portion 137*b* is an iron shell surrounding the bushing 131*a*.

The driving device 130 further includes a stator 133, a magnetic component 138 and a circuit board 132. The stator 133 includes a silicon steel strip and coil surrounding the silicon steel strip, and the circuit board 132 and the stator 133 are telescoped at the outside of the bushing 131*a*. The magnetic component 138 is disposed on an inner wall of the rotor 137. At least a part of the driving member 130 is covered by the first hub 141, and the first passive blades 142 radially encircle the driving member 130.

The first hub 141, the second hub 151 and the rotor 137 are calathiform with an opening, respectively, and the opening O1 of the first hub 141 and the opening O2 of the second hub 151 face the same direction, wherein the rotor 137 and the first hub 141 are disposed correspondingly wherein the opening O3 of the rotor 137 and the opening O1 of the first hub 141 face the same direction. The rotor 137 is disposed between the circular board 132 and the first hub 141.

The passive impeller 140 further includes a plurality of second passive blades 143 and an airflow guiding ring 144. The first passive blades 142 encircle the outer wall of the first hub 141, and the second passive blades 143 encircle the first passive blades 142. The airflow guiding ring 144 is disposed between the first passive blades 142 and the second passive blades 143 to connect the first passive blades 142 to the second passive blades 143, wherein the first passive blades 142 are connected to an inner wall of the airflow guiding ring 144, and the second passive blades 143 radially encircle the first passive blades 142 and are connected to the outer wall of the airflow guiding ring 144. Because of the height of the airflow guiding ring 144, an accommodating space 160 is formed by an inner wall of the first airflow guiding ring 144. The inner wall of the airflow guiding ring 144 is parallel to the axis a, but it is not limited thereto. The inner wall of the airflow guiding ring 144 can be inclined to the axis a. Lengths of the second passive blades 143 are larger than lengths of the first passive blades 142. Additionally, the active blades 152 face the first passive blades 142, and at least a portion of the active blades are disposed in the accommodating space 160. Specifically, in the accommodating space 160, the active blades 152 and the first passive blades 142 correspond to each other in an axial direction, but there is no connection therebetween. The direction of the airflow generated by the second passive blades 143 is different from or the same as the direction of the airflow generated by the active blades 152, which depends on the arranged angle of the blades.

Figure 4:
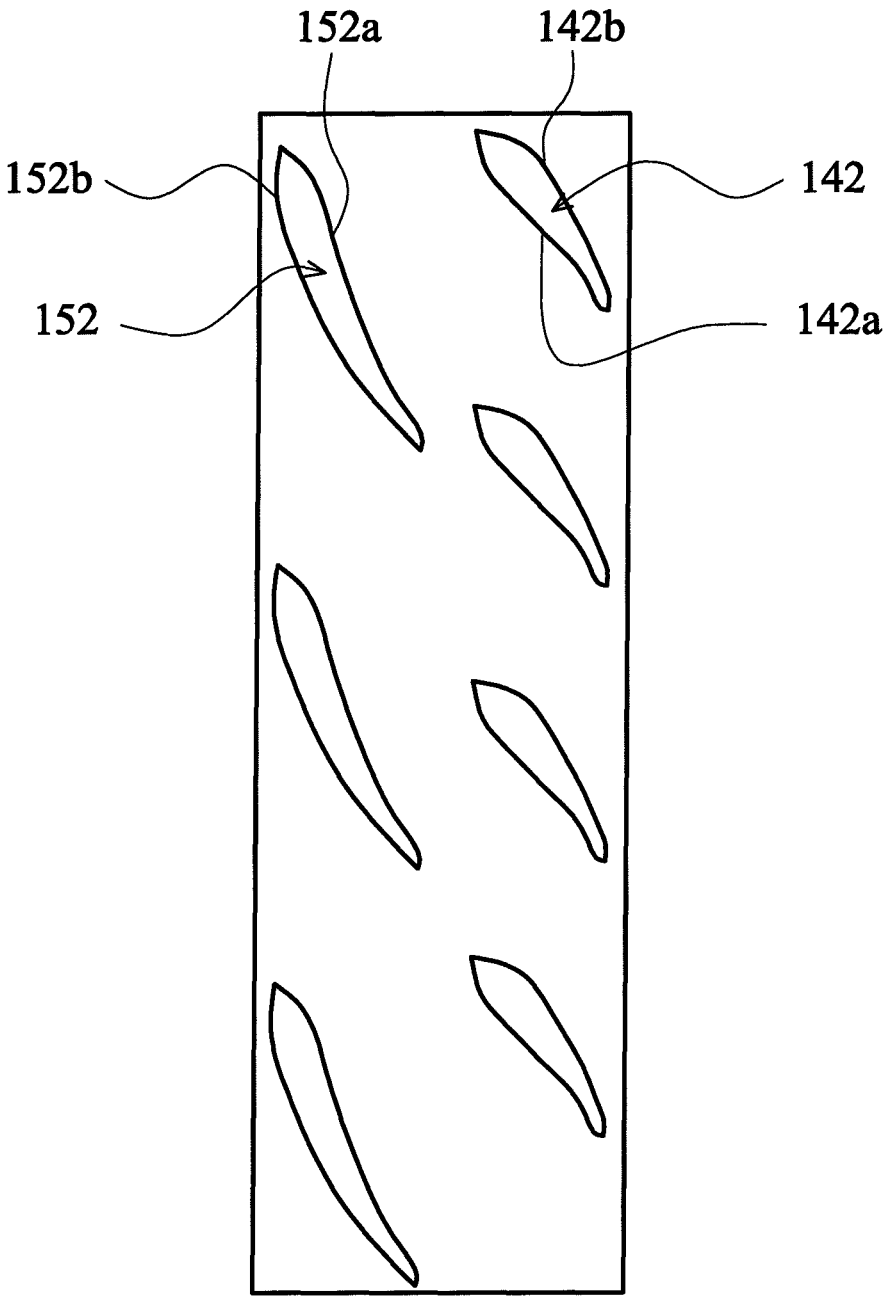
FIG. 4 is a schematic view of blade structures of the fan assembly of the first embodiment of the invention.

Please refer to FIG. 4. Each of the first passive blades 142 and each of the active blades 152 respectively have a concave surface 142*a*, 152*a* and a convex surface 142*b*, 152*b* on the opposite sites of the each blades 142, 152, and the concave surface 152*a* of each of the active blades 152 faces to the concave surface 142*a* of each of the first passive blades 142 so that a rotating direction of the active blades 152 is the same as that of the first passive blades 142.

Figure 5:
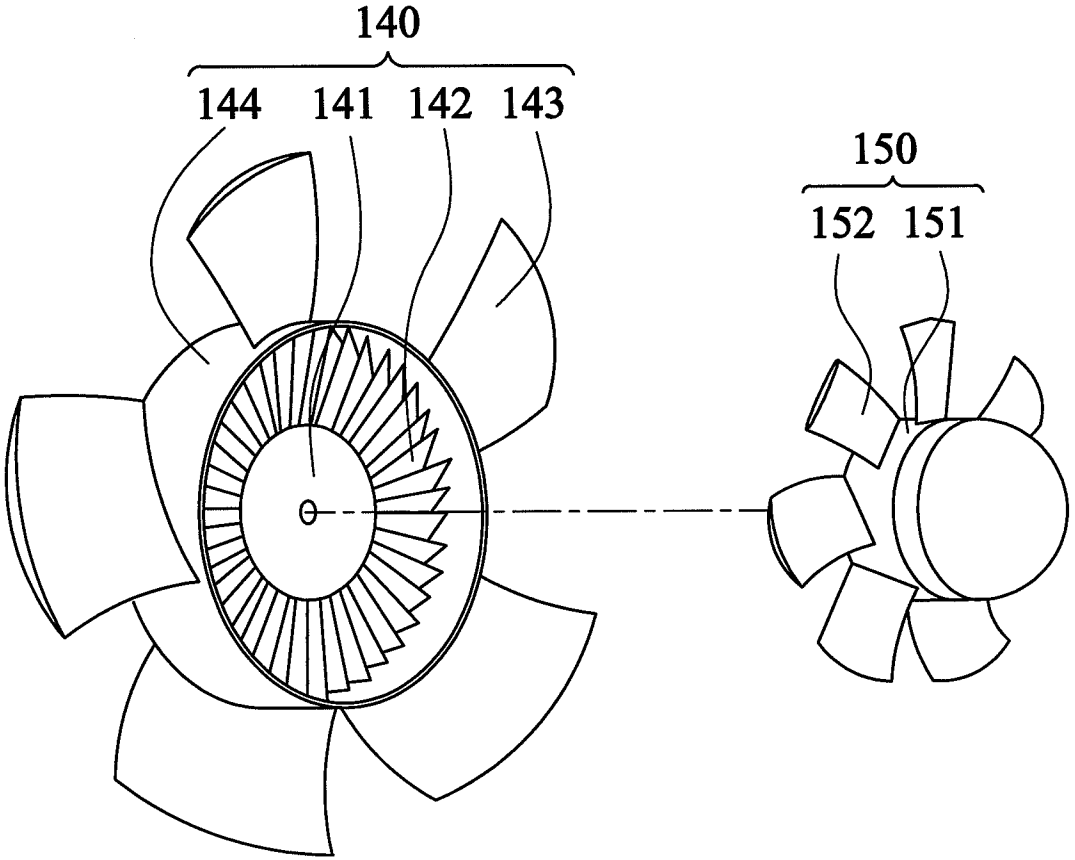
FIG. 5 is a partially explosive view of the fan assembly of the first embodiment of the invention.

Please refer to FIGS. 3A and 5. In the embodiment, the first passive blades 142 are overlapped by a neighboring first passive blade 142 in the axis a to increase air pressure.

Figure 6:
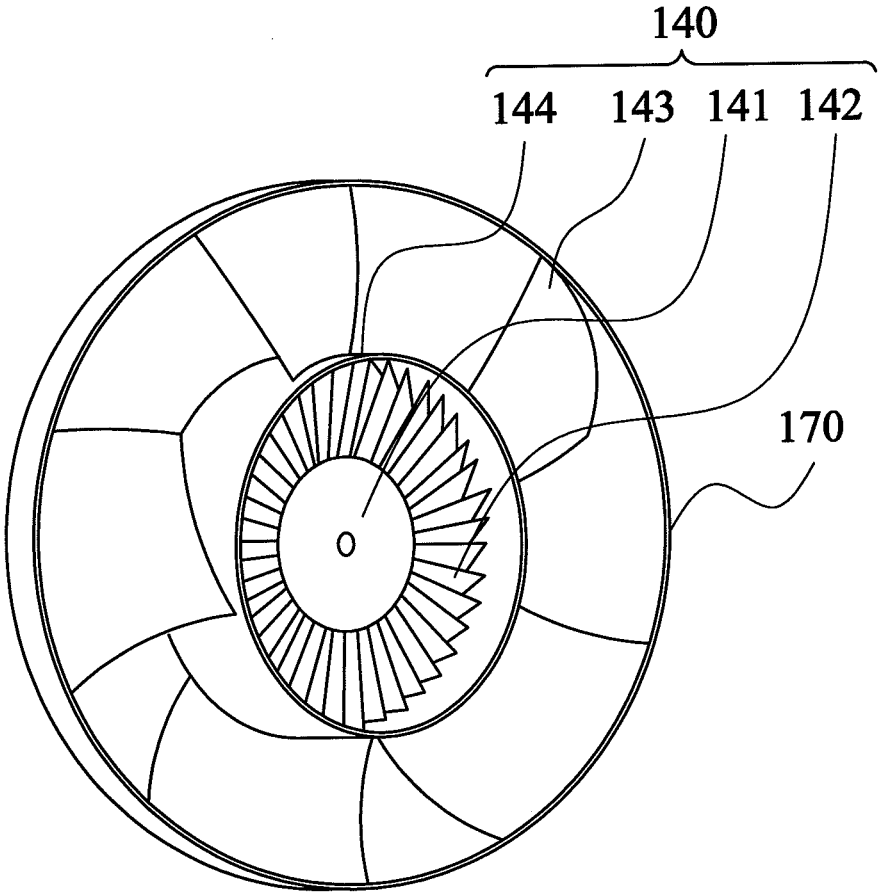
FIG. 6 is a schematic view of partial components of the fan assembly of the first embodiment of the invention.

As shown in FIG. 6, an enforcing ring 170 encircles the outer edges of the second passive blades 143 to enhance the structural strength of the second passive blades 143. Overall, the first hub 141, the first passive blades 142, the airflow guiding ring 144, the second passive blades 143, and the enforcing ring 170 are integrally formed as a single piece.

Please refer to FIG. 3A. The shaft 135 is connected to the connecting portion 137*a* of the rotor 137 and the active impeller 150. Thus, when the magnetic components 138 disposed on the rotor 137 are propelled by the stator 133, the active impeller 150 is driven. While at the same time, the passive impeller 140, connected to the shaft 135 via the second bearing 136, is not directly driven by the shaft 135. In fact, the passive impeller 140 is actuated by airflow produced by the active impeller, 150. The design theorem of the invention is described below.

In the beginning, the stator 133, disposed in the driving device 130, receives an electrical signal from the circuit board 132 and produces a magnetic field to actuate the rotor 137 to rotate. Thus, the active blades 152 are rotated, and the work, generated by the active blades 152, is:

$$(\Delta P+\tfrac{1}{2}\rho v_a^2+\tfrac{1}{2}\rho v_t^2)Q_i,$$

where:

$\tfrac{1}{2}\rho v_a^2$ represents a kinetic energy of the airflow in the axial direction a;

$\tfrac{1}{2}\rho v_t^2$ represents a kinetic energy of the airflow in tangential direction t;

$\Delta P$ represents a pressure difference between a pressure in the accommodating space 160 and air pressure; and $Q_i$ represents the amount of the airflow.

Because the airflow, generated by the active blades 152 which are disposed in the airflow guiding ring 144, in the tangential direction t is impendent by the airflow guiding ring 144, the kinetic energy of the airflow in tangential direction t is transformed to the first passive blades 142 causing simultaneous rotation of the first passive blades 142 and the second passive blades 143. See equation (I):

$$\eta\left[Q_i\left(\left(\Delta P+\frac{1}{2}\rho v_t^2\right)\right)\right]\xrightarrow[\text{transferred kinetic energy in the tangential direction } t]{}Q_o\ \frac{1}{2}\rho v_{ao}^2 \quad (I),$$

where:

$\tfrac{1}{2}\rho v_{ao}^2$ represents a kinetic energy of the airflow generated by the second passive blades 143 in the axial direction a; and $Q_o$ represents the amount of the airflow generated by the second passive blades 143.

Consequently, by means of transforming the kinetic energy of the airflow in tangential direction t, the amount of airflow $Q_i$ generated by the active blades 152 of the fan assembly 100 of the embodiment is increased to $Q_t+Q_o$ that is:

$$Q_i \xrightarrow[\text{purpose of the invention}]{} Q_i + Q_o.$$

According to the above descriptions, it is understood that in this embodiment, the driving device 130 is configured to drive the active impeller 150 only, and the rotation of the passive impeller 140 is actuated subsequently. Thus, the purpose of the embodiment to provide a fan assembly which has a light weight and a greater airflow amount is achieved. It is noted that as the fan assembly 100 operates, a heavier weight of the second passive blades 143 causes a slower rotating speed of the first passive blades 142 relative to the active blades 152.

Figure 7:
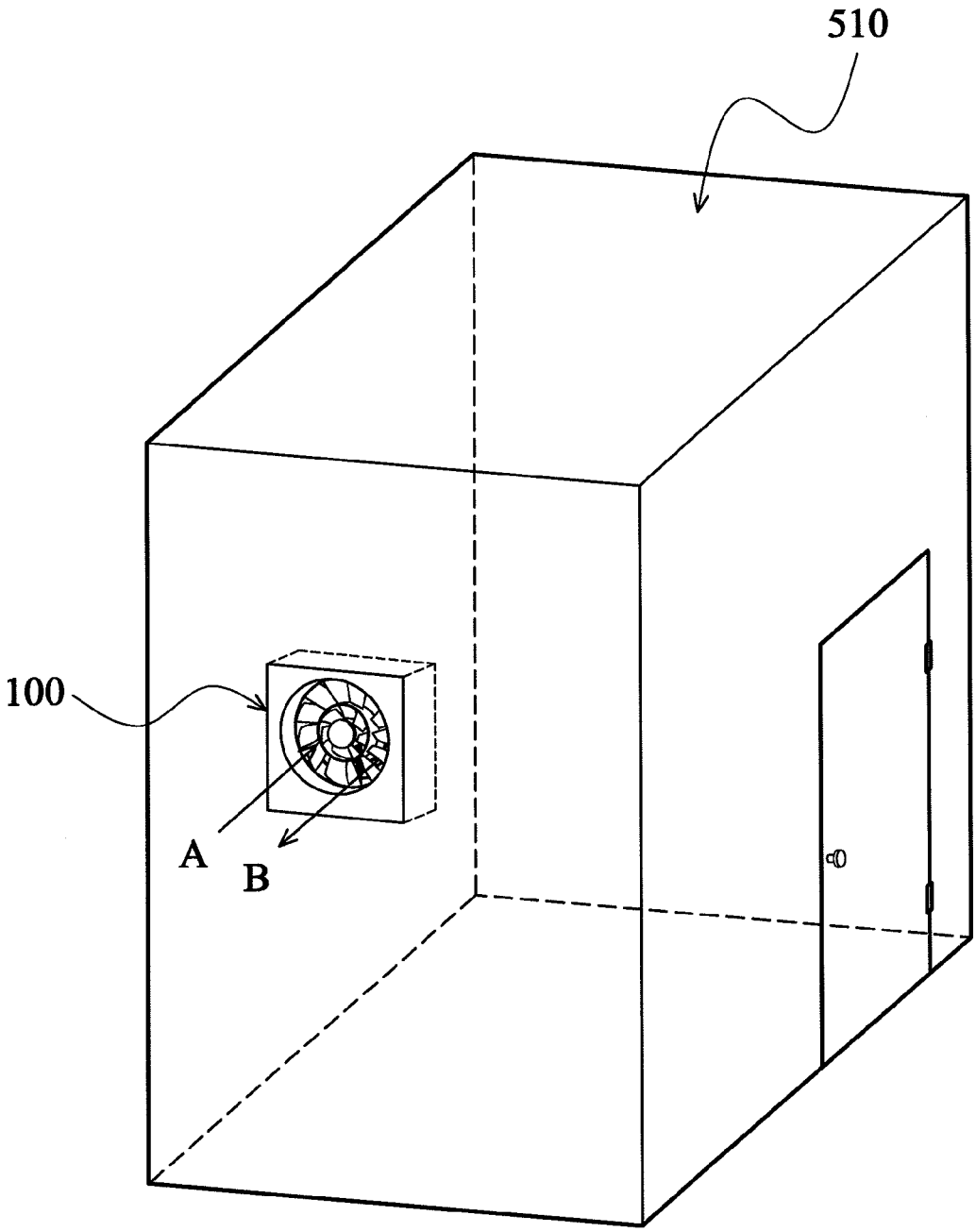
FIG. 7 illustrates a possible application of the invention being applied in a closed room.
Figure 8:
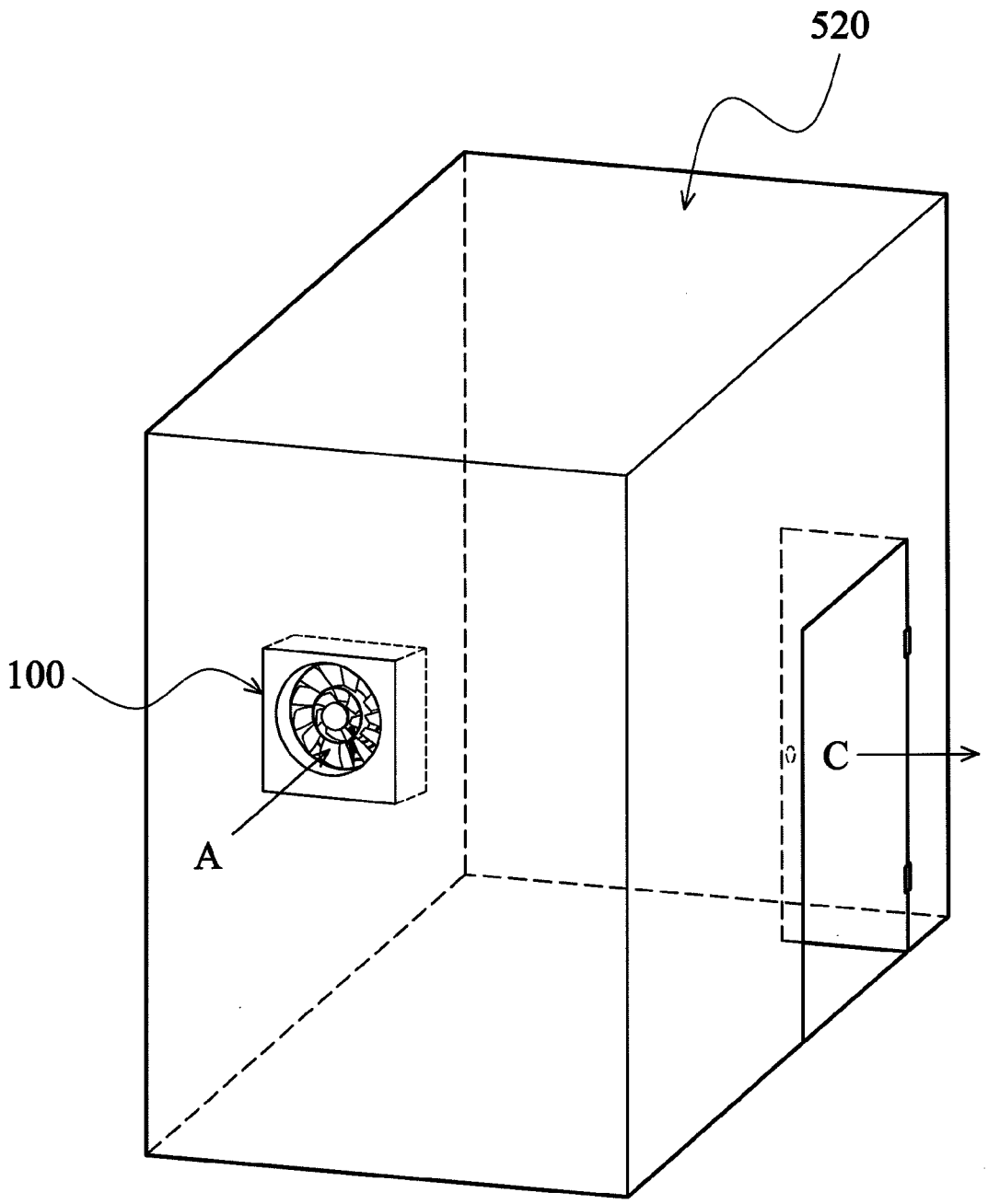
FIG. 8 illustrates another possible application of the invention being applied in an open room.

The application of the invention is described below. FIG. 7 illustrates a possible application of the fan assembly 100 of the invention being applied in a closed room 510, and FIG. 8 illustrates another possible application of the fan assembly 100 of the invention being applied in an open room 520. According to the different desires of a user, the second passive blades 143 of the embodiment are designed to be different angles, which may be applied in different situations.

For example, in a case of the fan assembly 100 applied in a closed room 510, the active blades 152 and the first passive blades 142 are designed to be inclined at an angle which is different from that of the second passive blades 143. In this case, the mechanical work produced by the active blades 152 and the first passive blades 142 is transferred to the air along a direction A. On the other hand, the mechanical work produced by the second passive blades 143 is transferred to the air along a direction B. As shown in FIGS. 3B and 7, the direction A is opposite to the direction B, so that interchange of the interior air and the exterior air can be performed.

Take another situation for example, in a case where the fan assembly 100 is applied in an opened room 520, because all blades are inclined to an identical or similar angle, mechanical work done to air by the active blades 152, the first passive blades 142, and the second passive blades 143 act along a direction A simultaneously, so as to guide the exterior air into the room 520. Note that although the first passive blades 142 and the second passive blades 143 rotate in the same direction, a user can cleverly modify the design to satisfy different desires.

Figure 9:
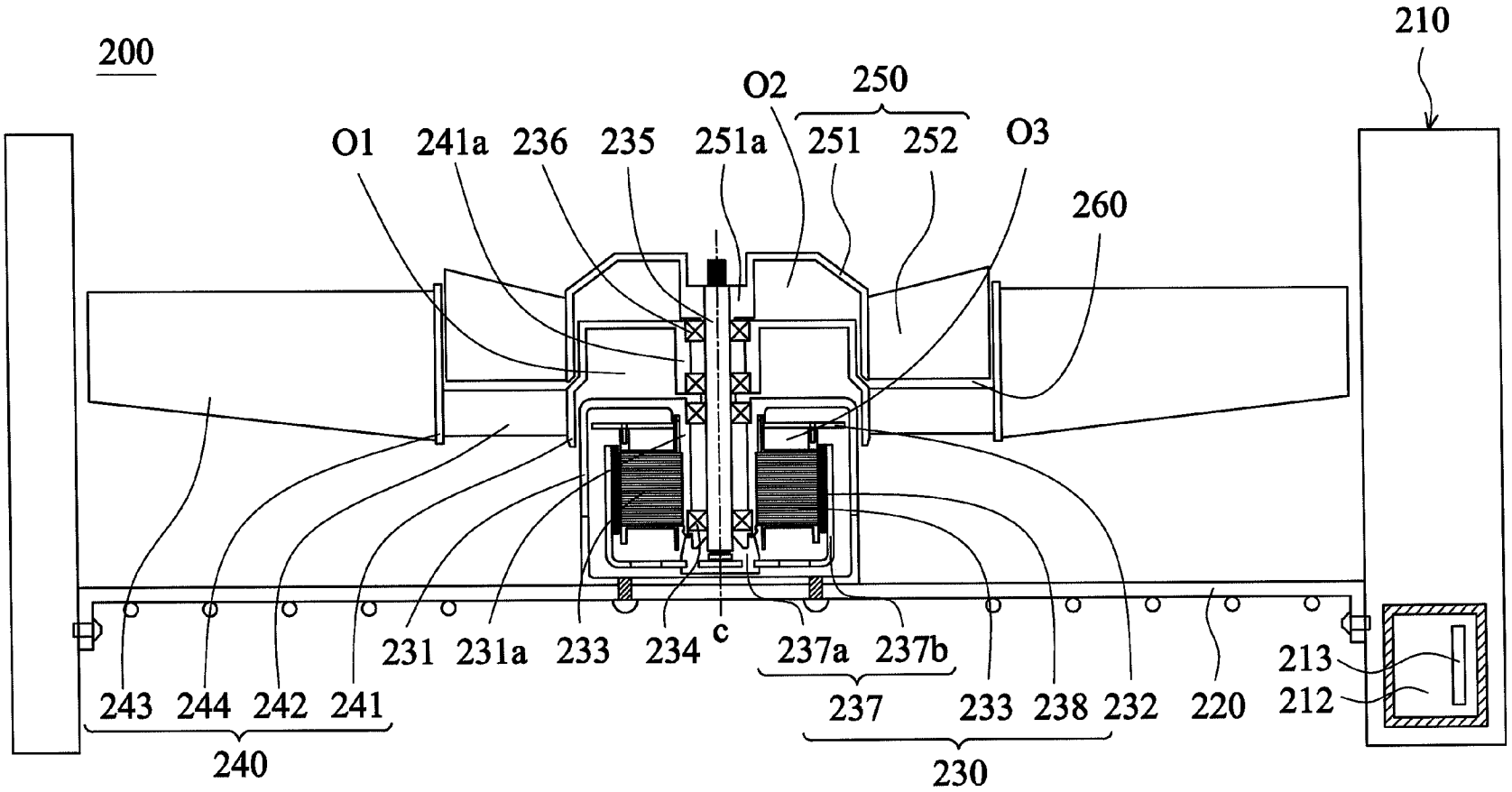
FIG. 9 is a sectional schematic view of a fan assembly of a second embodiment of the invention.

Please refer to FIG. 9. FIG. 9 illustrates a sectional schematic view of the second embodiment of the invention. In this embodiment, the fan assembly 200 includes a housing 210, a supporting member 220, a base 231, a driving device 230, a passive impeller 240, an active impeller 250, a shaft 235, a bushing 231*a* and at least a first bearing 234 and at least a second bearing 236.

The supporting member 220 is disposed in the housing 210, and the driving device 230 is disposed on the supporting member 220. The passive impeller 240 includes a first hub 241 and a plurality of first passive blades 242 encircles the first hub 241. The active impeller 252 includes a second hub 251 and a plurality of active blades 252 encircling the second hub 251. The second hub 251 has an engagement portion 251*a* for connecting to the shaft 235 so as to allow the driving device 220 to drive the active impeller 252 to rotate. The first hub 241 of the passive impeller 240 is disposed between the driving device 230 and the second hub 251 in an axial direction. Airflow is produced by the active impeller 250, and the passive impeller 240 is actuated by the airflow.

The active impeller 250 is connected to the shaft 235 and driven by the driving device 230 via the shaft 235. The shaft 235 and the bushing 231*a* is extended along a direction parallel to an axis c, and the driving device 230 surrounds the bushing 231*a*, wherein the shaft 235 is telescoped within the bushing 231*a*. The first hub 241 of the passive impeller 240 is a calathiform, and a protrusion 241*a* is extended from the first hub 241, wherein the shaft 235 is telescoped within the protrusion 241*a*. At least a first bearing 234 is disposed between the shaft 235 and the bushing 231*a*, and at least a second bearing 236 is disposed between the shaft 235 and the protrusion 241*a*. The shaft 235 passes through the first bearings 234 and the second bearing 236. The protrusion 241*a* extends along a direction toward the driving device 230. A gap is constituted between the active impeller 250 and the passive impeller 240, such that there is no connection between the active impeller 250 and the passive impeller 240.

The base 231 is connected to the bushing 231*a* with the support member 220, wherein the base 231 and the bushing 231*a* are preferably formed integrally. The base 131 is a hollowed shell covering the driving device 230.

The driving device 230 further includes a rotor 237 which is connected to the shaft 235 to actuate the shaft 235 to rotate. The rotor 237 is connected to an end of the shaft 235. The rotor 137 further includes a connecting portion 237*a* and a mounting portion 237*b*, wherein the connecting portion 237*a* is connected to the shaft 235, and the mounting portion 237*b* is an iron shell and surrounds the bushing 231*a*.

The driving device 230 further includes a stator 233, a magnetic component 238 and a circuit board 232. The stator 233 includes a silicon steel strip and coil surrounding the silicon steel strip, and the circuit board 232 and the stator 233 are telescoped at the outside of the bushing 231*a*, and the magnetic component 238 is disposed on an inner wall of the rotor 237. At least a part of the driving member 230 is covered by the first hub 241, and the first passive blades 242 radially encircle the driving member 230.

The first hub 241, the second hub 251 and the rotor 237 are calathiform with an opening, respectively, and the opening O1 of the first hub 241 and the opening O2 of the second hub 251 face the same direction. The rotor 237 and the first hub 241 are disposed inversely wherein the opening O3 of the rotor 237 and the opening O1 of the first hub 241 face the opposite directions. The circular board 232 is disposed between the rotor 237 and the first hub 241.

The passive impeller 240 further includes a plurality of second passive blades 243 and an airflow guiding ring 244. The first passive blades 242 encircle the outer wall of the first hub 241, and the second passive blades 243 encircle the first passive blades 242. The airflow guiding ring 244 is disposed between the first passive blades 242 and the second passive blades 243 to connect the first passive blades 242 with the second passive blades 243, wherein the first passive blades 242 are connected to an inner wall of the airflow guiding ring 244, and the second passive blades 243 radially encircle the first passive blades 242 and are connected to an outer wall of the airflow guiding ring 244. Because of the height of the airflow guiding ring 244, an accommodating space 260 is formed by an inner wall of the first airflow guiding ring 244. At least a portion of the active blades are disposed in the accommodating space.

As previously noted, the characteristic feature of the fan assembly of the invention is that the tangential airflow generated by the active blades is utilized to rotate the first and second passive blades, wherein a heavier weight of the second passive blades causes a slower rotating speed relative to the active blades. Specifically, the kinetic energy of the airflow in a tangential direction, with less attribution for heat dissipation, is reused to propel the other blades which have larger sizes. Thus, the driving device, i.e. an electrical motor, can work at high efficiency, and the performance of the fan assembly is increased.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan assembly, comprising:

a housing;

a supporting member, disposed in the housing;

a driving device, disposed on the supporting member;

a passive impeller, comprising a first hub and a plurality of first passive blades encircling the first hub; and an active impeller, comprising a second hub and a plurality of active blades encircling the second hub and actuated to rotate by the driving device;

wherein the first hub is disposed between the driving device and the second hub, and through an airflow produced by the active impeller, the passive impeller is actuated to rotate;

wherein when the passive impeller is blown by the airflow, the passive impeller rotates so as to increase the total amount of the airflow.

2. The fan assembly as claimed in claim 1 further comprising a shaft, wherein the active impeller is connected to the shaft, and the active impeller is driven by the driving device via the shaft.

3. The fan assembly as claimed in claim 2 further comprising a bushing, wherein the bushing is surrounded by the driving device, and the shaft is telescoped within the bushing.

4. The fan assembly as claimed in claim 3, wherein the first hub of the passive impeller comprises a protrusion, and the shaft is telescoped within the protrusion, wherein the protrusion extends along a direction toward the driving device or a direction away from the driving device.

5. The fan assembly as claimed in claim 3, wherein one end of the shaft is connected to the second hub, and another end of the shaft passes through the first hub and is telescoped within the bushing.

6. The fan assembly as claimed in claim 1, wherein at least a part of the driving device is covered by the first hub, and the first passive blades encircle the driving device.

7. The fan assembly as claimed in claim 1, wherein the active blades and the first passive blades are disposed correspondingly in an axial direction.

8. The fan assembly as claimed in claim 1, wherein each of the active blades and each of the first passive blades respectively has a concave surface and a convex surface on two opposite sides, and the concave surfaces of the active blades face the concave surfaces of the first passive blades.

9. The fan assembly as claimed in claim 1, wherein each of the first passive blades is overlapped by a neighboring first passive blade in an axial direction.

10. The fan assembly as claimed in claim 1, wherein the housing has an airflow passage penetrating through the housing, and the housing further comprises a chamber configured to receive at least one electronic element.

11. The fan assembly as claimed in claim 1, wherein a gap is constituted between the active impeller and the passive impeller, such that there is no connection between the active impeller and the passive impeller.

12. The fan assembly as claimed in claim 1, wherein a rotating direction of the active blades is the same as a rotating direction of the first passive blades.

13. The fan assembly as claimed in claim 1, wherein the passive impeller further comprises a plurality of second passive blades encircling the first passive blades.

14. The fan assembly as claimed in claim 13, wherein the passive impeller further comprises a first airflow guiding ring disposed between the first passive blades and the second passive blades to connect the first passive blades to the second passive blades, wherein the first passive blades are connected to an inner wall of the first airflow guiding ring and the second passive blades are connected to an outer wall of the first airflow guiding ring.

15. The fan assembly as claimed in claim 14, wherein an accommodating space is formed by the inner wall of the first airflow guiding ring, and at least a portion of the active blades are disposed in the accommodating space.

16. The fan assembly as claimed in claim 14, wherein the inner wall of the first airflow guiding ring is parallel to or inclined with respect to an axis.

17. The fan assembly as claimed in claim 13, wherein the second passive blades radially encircle the first passive blades.

18. The fan assembly as claimed in claim 13, wherein the passive impeller further comprises an enforcing ring encircling the outer edges of the second passive blades.

19. The fan assembly as claimed in claim 13, wherein lengths of the second passive blades are larger than lengths of the first passive blades.

20. The fan assembly as claimed in claim 13, wherein a direction of the airflow generated by the second passive blades is different from or the same as a direction of the airflow generated by the active blades.

21. The fan assembly as claimed in claim 2, wherein the passive impeller is rotatably connected to the shaft.

* * * * *